US007603880B2

(12) United States Patent
Chen

(10) Patent No.: US 7,603,880 B2
(45) Date of Patent: Oct. 20, 2009

(54) MORTISE LOCK

(76) Inventor: Te-Ming Chen, No. 18, Lane 91, Kui Jen Road, Pingtung CIty (TW)

( * ) Notice: Subject to any disclaimer, the term of this patent is extended or adjusted under 35 U.S.C. 154(b) by 139 days.

(21) Appl. No.: 11/953,082

(22) Filed: Dec. 10, 2007

(65) Prior Publication Data

US 2009/0145179 A1 Jun. 11, 2009

(51) Int. Cl.
*E05B 59/00* (2006.01)
*E05C 1/08* (2006.01)

(52) U.S. Cl. ..... 70/107; 70/110; 70/149; 70/467; 292/169; 292/169.14

(58) Field of Classification Search ..... 70/107–111, 70/149, 188, 189, 386, 422, 467, 472, 486; 292/169.14–169.16, 169.21–169.23, 252, 292/DIG. 27
See application file for complete search history.

(56) References Cited

U.S. PATENT DOCUMENTS 3,672,714 A * 6/1972 Schultz ..... 70/107
3,750,433 A * 8/1973 Sanders ..... 70/486
3,783,658 A * 1/1974 Wada ..... 70/110
4,674,776 A * 6/1987 James ..... 292/40
6,393,878 B1 * 5/2002 Fayngersh et al. ..... 70/107
6,622,535 B2 * 9/2003 Chiang et al. ..... 70/107
7,188,870 B2 * 3/2007 Huang ..... 70/107
7,303,215 B2 * 12/2007 Moon et al. ..... 70/107
7,452,012 B2 * 11/2008 Huang, Richard H ..... 70/107
2004/0089033 A1 * 5/2004 Lu ..... 70/107
2008/0011029 A1 * 1/2008 Chen ..... 70/107

* cited by examiner

*Primary Examiner*—Peter M Cuomo
*Assistant Examiner*—Christopher Boswell
(74) *Attorney, Agent, or Firm*—Leong C. Lei

(57) ABSTRACT

A mortise lock includes a case. A locking slide forms a bore to receive a spring and a steel ball to allow the locking slide to be slidable with respect to the lock case to abut against and/or disengage from a locking latch. The mortise lock is operated by turning an inside knob to drive a deadbolt and a latch lever and the locking slide is moved inward to engage a lever hub assembly thereby ensuring a locked condition. The mortise lock cannot be unlocked by operating an outside lever. When an inside lever is depressed, the lever hub assembly is driven to cause the rocker arm to push away a hooking lever and a knob spindle assembly, thereby retracting the deadbolt and the latch bolt and simultaneously moving the locking slide outward to show an unlocked condition, whereby the mortise lock can be unlocked by operating the outside lever.

2 Claims, 6 Drawing Sheets

MORTISE LOCK

BACKGROUND OF THE INVENTION (a) Technical Field of the Invention

The present invention relates to a mortise lock, and in particular to a mortise lock those allows for locking/unlocking with an outside lever or handle in order to ensure convenient and efficient operation of a door.

(b) Description of the Prior Art

An apartment or an access is often provided with a door with a locking device. The locking device includes a deadbolt, a latch bolt, and auxiliary latch bolt and often further comprise a locking latch that is operatively coupled to the auxiliary latch bolt so that normally the locking device can only be unlocked by an inside lever, but not an outside lever, unless a key is used. Thus, to ensure that one can unlock the door locking device from outside, one must secure the locking latch when the door is open to maintain the unlocked condition of the door locking device. This is to some extents troublesome to general users and is particularly true when a user, with no key with him or her, is locked outdoors by advertently closing the door. Under this situation, the user is kept from entering the door unless he or she has access to spare key.

Thus, it is desired to provide a mortise lock that allows a user to unlock from outside unless the lock is secured from inside so that the drawbacks and inconvenience occurring in the conventional mortise lock can be overcome.

SUMMARY OF THE INVENTION

The primary purpose of the present invention is to provide a mortise lock, which allows for locking/unlocking of the lock with an outside lever to ensure convenient and efficient operation of the lock.

In accordance with the present invention, the mortise lock comprises a lock case in which bolts, a latch lever, a locking slide, and a locking latch are arranged. The locking slide forms, on a side face thereof, a bore adjacent to a bottom thereof to receive therein a spring and a steel ball to allow the locking slide to be slidable with respect to the lock case to selectively abut against a locking latch or disengage from the locking latch. Thus, the mortise lock is operated by tuning an inside knob to rotate the knob spindle assembly, a deadbolt and the latch lever are driven and the locking slide is forced to move inward to engage a lever hub assembly thereby ensuring a locked condition of the mortise lock, whereby the mortise lock cannot be unlocked by operating an outside lever. When an inside lever is depressed or properly operated, the lever hub assembly is driven to cause the rocker arm to push away a hooking lever and a knob spindle assembly, thereby retracting the deadbolt and the latch bolt and simultaneously moving the locking slide outward to show an unlocked condition, whereby the mortise lock can be unlocked by operating the outside lever. As such, the operation of the mortise lock is convenient.

In the mortise lock discussed above, the lock case forms spaced holes at locations corresponding to the locking slide so that when the locking slide is movable in inward/outward direction, a steel ball arranged in the locking slide is selectively engageable with the holes to ensure proper positioning of the mortise lock.

In the mortise lock discussed above, the locking slide comprises a lid positioned thereon with springs and steel balls arranged between the lid and the locking slide to allow the lid to be rotatable with respect to the lock case and changing the abutting position against the latch lever to allow for change of direction of the latch bolt to embody either left-side opening or right-side opening.

The foregoing object and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
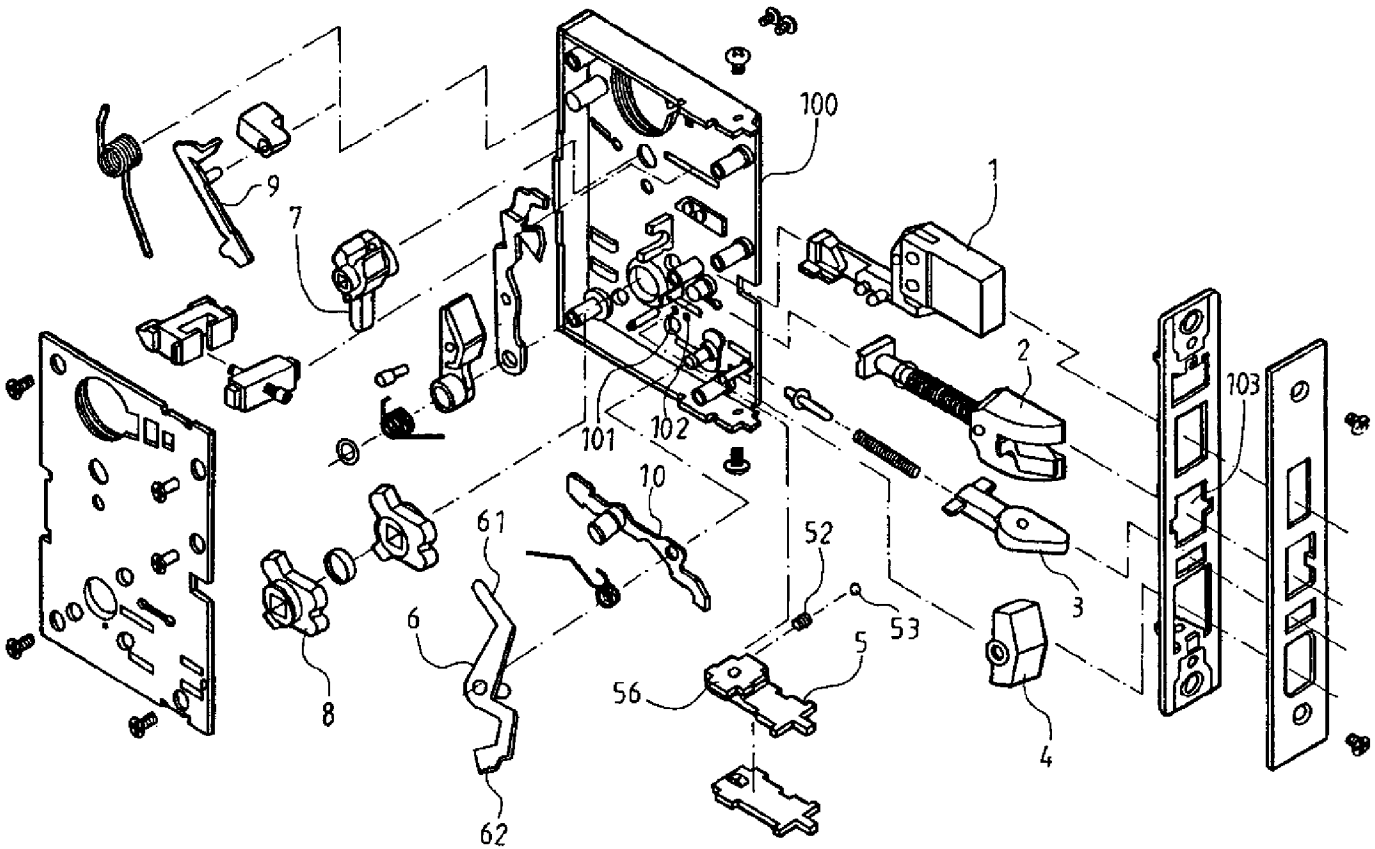
FIG. 1 shows an exploded view of a mortise lock constructed in accordance with the present invention.
Figure 2:
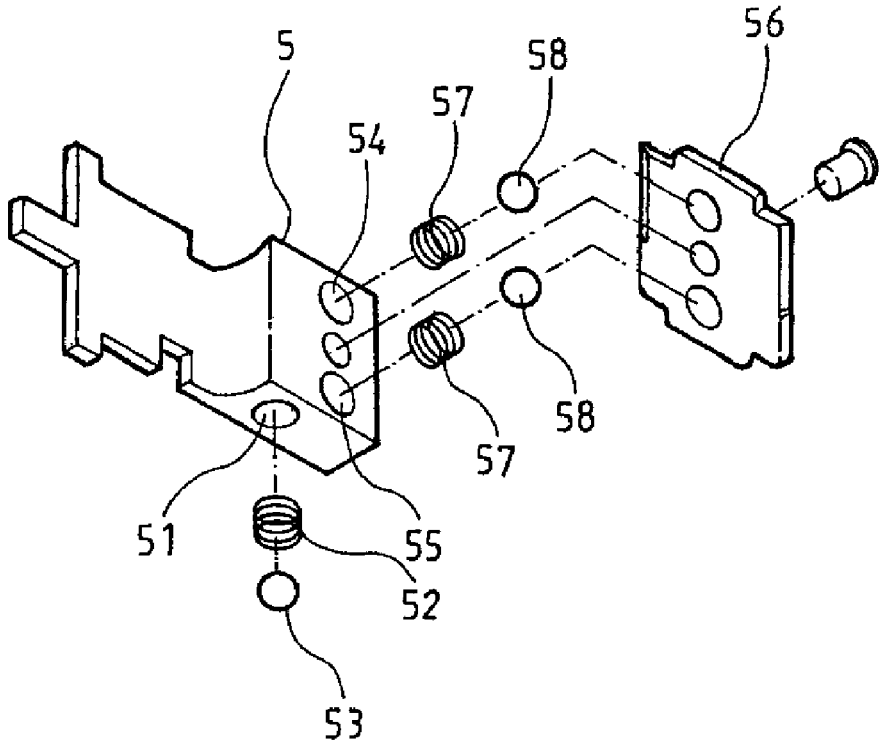
FIG. 2 shows a perspective view of a locking slide of the mortise lock of the present invention.
Figure 3:
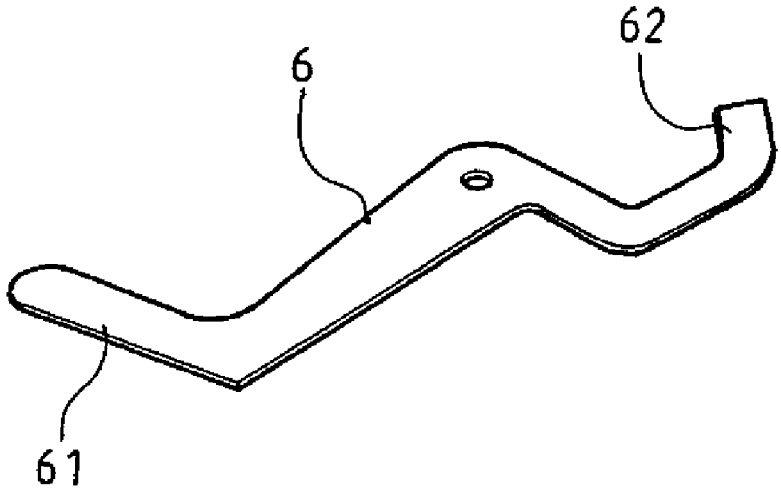
FIG. 3 shows a perspective view of a latch lever of the mortise lock of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

With reference to the drawings and in particular to FIGS. 1-4, which respectively shows an exploded view of a mortise lock constructed in accordance with the present invention, a perspective view of a locking slide of the mortise lock of the present invention, a perspective view of a latch lever of the mortise lock of the present invention, and a side elevational view, with a portion of a lock case removed, illustrating a locked condition of the mortise lock of the present invention, the mortise lock of the present invention comprises the lock case 100 in which a deadbolt 1, a latch bolt 2, an auxiliary latch bolt 3, a locking latch 4, a locking slide 5, a latch lever 6, a knob spindle assembly 7, a lever hub assembly 8, and a rocker arm 9 that is arranged in cooperation with the lever hub assembly 8, a hooking lever 10 arranged below the latch bolt 2. The lock case 100 forms through holes 101, 102 at locations corresponding to the locking slide 5 and also forms a cruciform slot 103 at a location corresponding to the latch bolt 2.

The locking slide 5 forms in a side face a bore 51 at a location adjacent to a bottom thereof to receive therein a spring 52 and a steel ball 53 so that when the locking slide 5 moves along the lock case 100, the steel ball 53 that is adjacent to the bottom of the locking slide 5 and is biased by the spring 52 selectively engages the holes 101, 102 of the lock case 100 for positioning the locking slide 5 at the locations corresponding to the holes 101, 102. A top face of the locking slide 5 forms bores 54, 55 in a symmetrical manner for positioning a lid 56. Arranged between the lid 56 and the bores 54, 55 of the locking slide 5 are springs 57 and steel balls 58. This allows the lid 56 to be rotatable with respect to the locking slide 5 to switch abutting positions against the latch lever 6 and thus allowing the latch bolt 2 to change direction for being adapted in left-side opening door and right-side opening door, respectively. In changing the direction of the latch bolt 2, the cruciform slot 103 defined in the lock case 100 enhances the rotation of the latch bolt 2.

The latch lever 6 comprises a lower hook section 62 from which a driving section 61 that is bent to a desired angle extends. A positioning hole (not labeled) is formed between the hook section 62 and the driving section 61 for mounting to the lock case 100.

The mortise lock of the present invention is formed by assembling the above discussed components together. When the mortise lock is operated by turning the inside knob to rotate the knob spindle assembly 7, the deadbolt 1 and the latch lever 6 are driven and the locking slide 5 is forced to move inward to engage the lever hub assembly 8 thereby ensuring the locked condition of the mortise lock, whereby the mortise lock cannot be unlocked by operating an outside lever. When an inside lever is depressed or properly operated, the lever hub assembly 8 is driven to cause the rocker arm 9 to push away the hooking lever 10 and the knob spindle assembly 7, thereby retracting the deadbolt 1 and the latch bolt 2. At the same time, the locking slide 5 is moved outward to show an unlocked condition, whereby the mortise lock can be unlocked by operating the outside lever. As such, the operation of the mortise lock is convenient.

Figure 4:
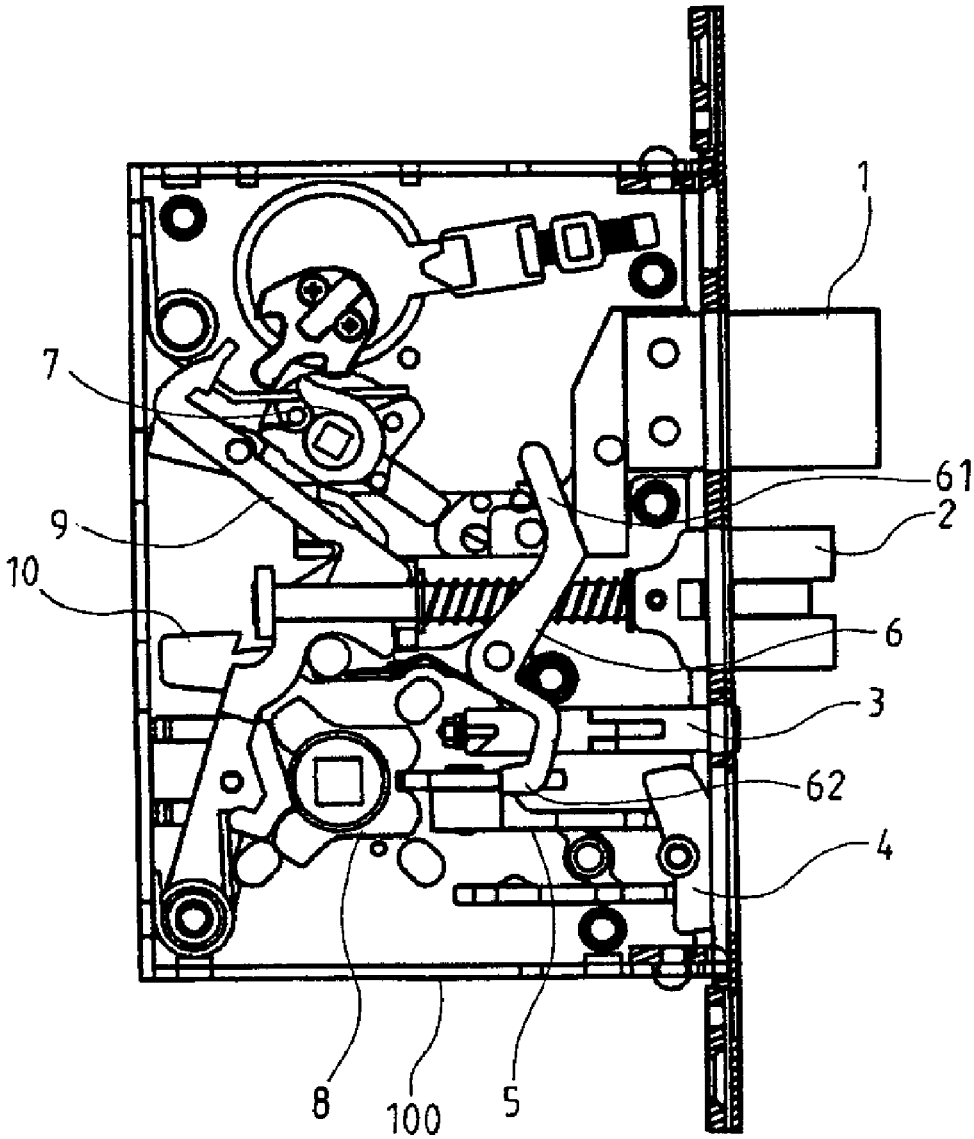
FIG. 4 is a side elevational view, with a portion of a lock case removed, illustrating a locked condition of the mortise lock of the present invention.

Referring to FIG. 4, which, as mentioned above, illustrates a locked condition of the mortise lock of the present invention, when the mortise lock of the present invention is operated by an inside knob that rotates the spindle assembly 7, which in turn drives and stretches the deadbolt 1 outward and also actuates the latch lever 6 to force the locking slide 5 to move inward to engage the lever hub assembly 8 thereby securing the lever hub assembly 8 to ensure the locked condition. As such, due to the lever hub assembly 8 being secured, the outside lever is not allowed to operate the mortise lock.

Figure 5:
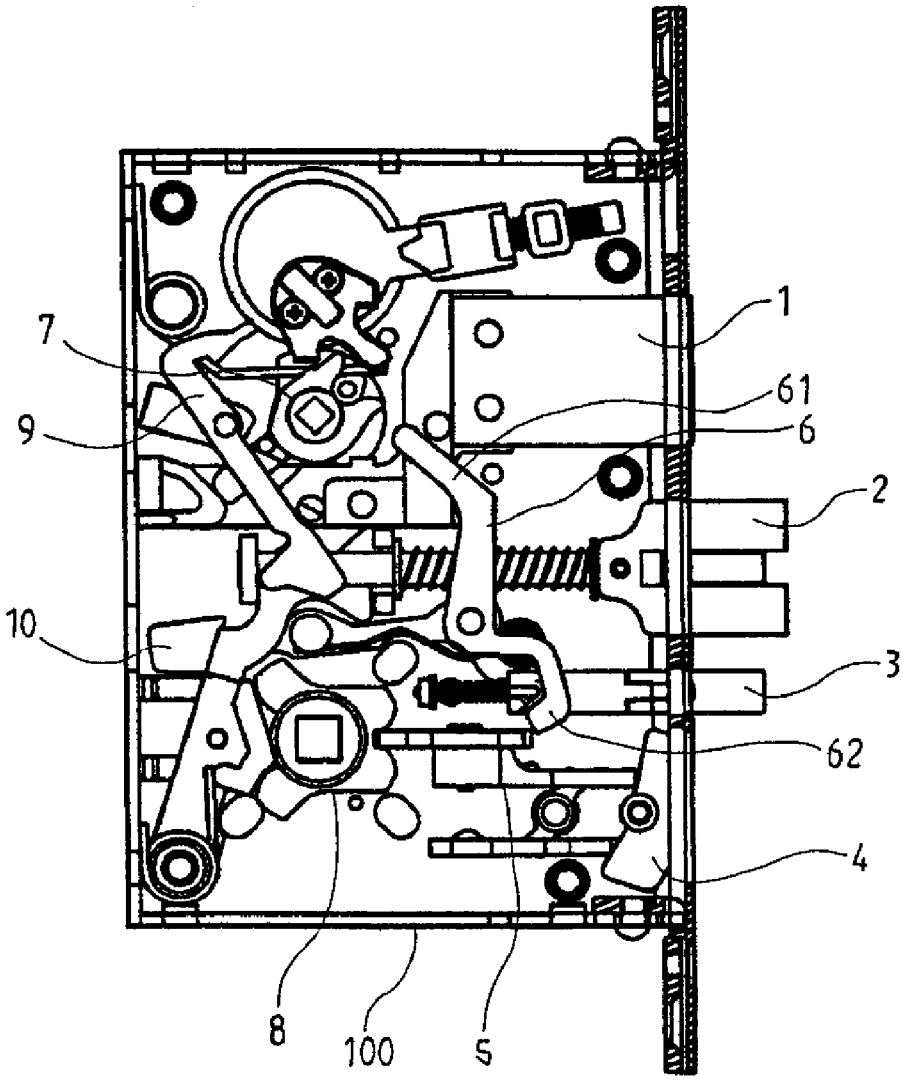
FIG. 5 illustrates an unlocked condition of the mortise lock of the present invention.

Referring to FIG. 5, which illustrates an unlocked condition of the mortise lock, when the inside lever of the mortise lock is depressed, the lever hub assembly 8 is rotated in a reversed direction, which causes the rocker arm 9 to push away the hooking lever 10 and the spindle assembly 7, thereby retracting the deadbolt 1 and the latch bolt 2. At the time when the deadbolt 1 is retracted into the lock case 100, the latch lever 6 changes direction and pushes the locking slide 5 outward to show the unlocked condition, whereby the outside lever is free to unlock the mortise lock. This provides enhanced convenience for the operation of the mortise lock, especially when a user is temporarily out of his or her house with no key with him or her.

Figure 6:
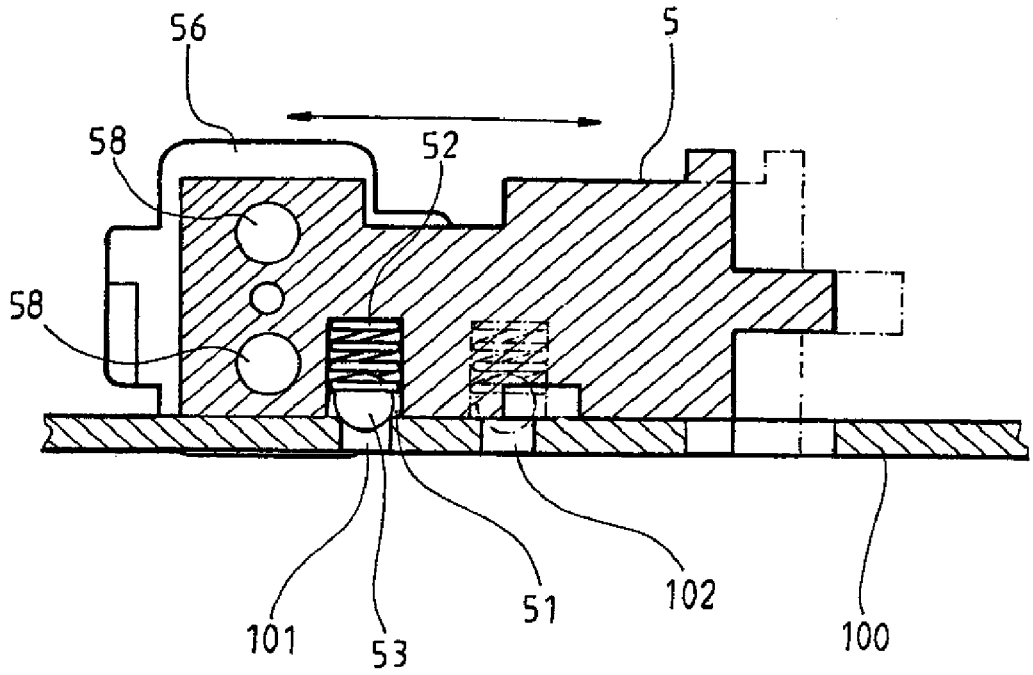
FIG. 6 is a cross-sectional view illustrating the operation of the locking slide of the mortise lock of the present invention.

Referring to FIG. 6, which illustrates the operation of the locking slide 5 of the mortise lock of the present invention, the lock case 100 is provided with two spaced holes 101, 102 at locations corresponding to the locking slide 5 so that when the locking slide 5 is moved to inside/outside extreme locations, the steel ball 53 arranged in the bore 51 that is adjacent to the bottom of the locking slide 5 is biased by the spring 52 to engage one of the holes 101, 102. When the locking slide 5 is carrying out a sliding motion between the holes 101, 102, the steel ball 53 is forced, against the spring force of the spring 52, into the bore 51 to allow the locking slide 5 to proceed from one hole 101 (or 102) to the other hole 102 (or 101) at which the steel ball 53 is again biased by the spring 52 to extend out and engage the hole 102. This ensures proper positioning of the locking slide 5 with respect to the lock case 100.

Although the present invention has been described with reference to the preferred embodiment thereof it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lock comprising a case in which a slide is movably arranged, the case forming spaced holes at locations corresponding to the slide, the slide forming a first bore in a side face at a location adjacent to a bottom thereof to receive therein a spring and a steel ball so that the slide, when put in movement with respect to the case, is positionable by having the steel ball adjacent to the bottom thereof selectively engaging the holes, the slide having a top in which second bores are defined for retaining a lid with a spring and a steel ball arranged between the lid and each second bore to allow the lid to be rotatable on the slide to change abutting position thereof against a latch lever and thus changing direction of a latch bolt to embody left-side opening or right-side opening, the latch lever having a lower hook section and a driving section extending from the hook section and being bent, the latch lever forming a positioning hole between the driving section and the hook section for mounting to the case, wherein when the lock is operated by turning an inside knob to rotate a knob spindle assembly, a deadbolt and the latch lever are driven and the slide is forced to move inward to engage a lever hub assembly thereby ensuring a locked condition of the lock, in which the lock is not allowed to be unlocked by operating an outside lever, and when an inside lever is depressed, the lever hub assembly is driven to cause the rocker arm to push away the hooking lever and the knob spindle assembly, thereby retracting the deadbolt and the latch bolt and simultaneously moving the slide outward to show an unlocked condition, whereby the lock allows for being unlocked by operating the outside lever.

2. The lock as claimed in claim 1, wherein the case forms a cruciform slot at a location corresponding to the latch bolt so that when the latch bolt is changed direction, the cruciform slot helps rotation of the latch bolt.

* * * * *